US005773749A

United States Patent [19]

Cotton, III et al.

[11] Patent Number: 5,773,749

[45] Date of Patent: Jun. 30, 1998

[54] FREQUENCY AND VOLTAGE DEPENDENT MULTIPLE PAYLOAD DISPENSER

[75] Inventors: Beryl W. Cotton, III, Lexington; David Wallace, Austin, both of Tex.

[73] Assignee: Tracor, Inc., Austin, Tex.

[21] Appl. No.: 486,241

[22] Filed: Jun. 7, 1995

[51] Int. Cl.[6] ..... F42C 11/00; B64D 1/00

[52] U.S. Cl. ..... 102/217; 102/200; 102/206; 89/1.51

[58] Field of Search ..... 102/217, 206, 102/200, 505, 345, 352, 360; 361/249; 89/1.51, 1.55, 1.56, 1.57, 1.6

[56] References Cited

U.S. PATENT DOCUMENTS

| | | | |
|---|---|---|---|
| 3,158,098 | 11/1964 | Reithel | 102/28 |
| 3,453,496 | 7/1969 | Wright et al. | 317/80 |
| 3,559,582 | 2/1971 | Hrzek | 102/70.2 |
| 3,712,170 | 1/1973 | Campagnuolo et al. | 89/1.814 |
| 3,728,935 | 4/1973 | Mogorian | 89/1.811 |
| 3,745,925 | 7/1973 | Hester, Jr. | 102/70.2 R |
| 3,888,181 | 6/1975 | Kups | 102/70.2 |
| 3,892,182 | 7/1975 | Covarrubias et al. | 102/70.2 R |
| 4,068,556 | 1/1978 | Foley | 89/1.814 |
| 4,095,527 | 6/1978 | Moore, III | 102/19.2 |
| 4,135,455 | 1/1979 | Wallace | 102/217 |
| 4,141,297 | 2/1979 | Sellwood | 102/206 |
| 4,145,968 | 3/1979 | Klein | 102/46 |
| 4,154,168 | 5/1979 | Campbell et al. | 102/505 |
| 4,246,845 | 1/1981 | Winton et al. | 102/206 |
| 4,273,051 | 6/1981 | Stratton | 102/202.2 |
| 4,313,379 | 2/1982 | Wallace | 102/217 |
| 4,325,304 | 4/1982 | Ormiston | 102/200 |
| 4,388,867 | 6/1983 | Baumer | 102/211 |
| 4,395,950 | 8/1983 | Oswald | 102/200 |
| 4,422,379 | 12/1983 | Geller et al. | 102/206 |
| 4,445,434 | 5/1984 | Brede et al. | 102/206 |
| 4,454,814 | 6/1984 | Henry et al. | 102/200 |
| 4,487,125 | 12/1984 | Zuk | 102/220 |
| 4,493,259 | 1/1985 | Münzel | 102/218 |
| 4,537,131 | 8/1985 | Saunders | 102/217 |
| 4,592,281 | 6/1986 | Nagennast | 102/254 |
| 4,615,268 | 10/1986 | Nakano et al. | 102/217 |
| 4,646,640 | 3/1987 | Florin et al. | 102/217 |
| 4,674,047 | 6/1987 | Tyler et al. | 364/423 |
| 4,685,396 | 8/1987 | Birse et al. | 102/200 |
| 4,802,414 | 2/1989 | Fiedler et al. | 102/206 |
| 4,829,899 | 5/1989 | Wiker et al. | 102/206 |
| 4,846,066 | 7/1989 | Beattie et al. | 102/217 |
| 4,986,183 | 1/1991 | Jacob et al. | 102/200 |
| 5,014,622 | 5/1991 | Jullian | 102/312 |
| 5,069,129 | 12/1991 | Kunitomo | 102/217 |
| 5,113,766 | 5/1992 | Grosch | 102/427 |
| 5,157,222 | 10/1992 | La Mura et al. | 102/360 |
| 5,185,528 | 2/1993 | Gordon | 250/341 |
| 5,284,094 | 2/1994 | La Mura et al. | 102/217 |
| 5,351,597 | 10/1994 | Holmström et al. | 89/6.5 |
| 5,631,439 | 5/1997 | Sallee et al. | 102/217 |

OTHER PUBLICATIONS

"AN/ALE–40 Threat Adaptive Dispenser System (TADS) Upgrade", Tracor Aerospace, Date Unknown.

*Primary Examiner*—Michael J. Carone
*Assistant Examiner*—Theresa M. Wesson
*Attorney, Agent, or Firm*—Liddell, Sapp, Zivley Hill & LaBoon. L.L.P.

[57] ABSTRACT

As voltage and frequency dependent multiple payload dispenser system in which a variable voltage or frequency signal source is used to selectively fire squibs based on the pass voltages and pass frequencies of a filter network. The filter network is placed near, or incorporated into, the payload dispenser itself or attached to the magazine, reducing system wiring.

18 Claims, 9 Drawing Sheets

DISPENSER HOLES
202
200
206
200
206
110
111
VOLTAGE/ FREQUENCY SOURCE
108

DISPENSER HOLES
210
208
212
214
216
111
126
128
130
ELECTRICAL SEQUENCER SWITCH
132
110
111
VOLTAGE/ FREQUENCY SOURCE
108

FREQUENCY AND VOLTAGE DEPENDENT MULTIPLE PAYLOAD DISPENSER

BACKGROUND OF THE INVENTION

1. Field of the Invention

The invention relates to electrically initiated expendable payload dispenser systems, and more particularly to a multiple payload dispenser system that selectively fires payloads depending on voltage and frequency.

2. Description of the Related Art

In both military and civilian environments, it is often desirable to distribute payloads over a wide area. Military aircraft and vehicles need to fire a variety of such payloads, such as flares, chaff, jammers, and pamphlets and other propaganda material. In a civilian environment, such payloads can include seed, fertilizer, or a wide variety of other payloads.

To service this need, various systems for dispensing payloads have been developed. Perhaps the most commonly used is the electrically initiated payload dispenser. In a basic form of such a system, payloads such as chaff are placed in holes in a payload magazine, which typically has 30 such magazine holes. This loaded payload magazine is then bolted to a payload dispenser, which contains a number of contacts for forming an electrical connection with firing charges, or "squibs," within each payload, which are small electrically initiated charges that explosively expel the payload from the magazine hole.

In typical dispenser systems, each payload magazine includes a number of magazine holes that each holds a payload with its corresponding squib. The payload dispenser has a corresponding number of electrical contacts for each squib. Each dispenser contact for each magazine hole is typically wired to an electrical sequencer switch, which can be either a mechanical type switch or a solid state type switch, which selectively directs firing current to the desired magazine hole through the payload dispenser.

Further, some systems have been adapted to provide for greater utilization of existing dispensers by placing multiple payloads in each magazine hole. In such a system the multiple payloads are typically placed either end-to-end or side-by-side within each magazine hole, and each payload includes a separate squib to fire the payload. The squibs are then either separately wired or circuitry is integrated into the multiple payload unit itself that allows for the discrimination of voltage levels to selectively fire the squibs. In the first case using separate wiring, the standard electrical sequencer switch directs firing current through a dispenser contact to the appropriate squib, with two signals being provided to each magazine hole. In the latter case using a single conductor, an electrical sequencer switch is still used, but only a single signal is provided through a single dispenser contact to each magazine hole. To selectively fire the multiple squibs within each magazine hole, a variable firing voltage is routed by the electrical sequencer switch to the selected magazine hole. A first voltage fires the first payload, while a second, higher voltage fires a second payload.

Such voltage encoded systems are described in U.S. Pat. No. 4,313,379 to Wallace, issued Feb. 2, 1982, entitled "Voltage-Coded Multiple Payload Cartridge," which is incorporated by reference. Further, typical multiple payload cartridge systems illustrating a multiple payload multi-squib combination cartridge are illustrated in U.S. Pat. No. 4,135,455 to Wallace, issued Jan. 23, 1979, entitled "Multiple Payload Cartridge Employing Single Pair of Electrical Connections," which is also incorporated by reference.

In all of this discussion, the specific description of the ground contacts has been omitted. Typically, the various components of the payload dispenser system rely on a common, chassis ground. Further, the squibs themselves have a firing contact and a ground contact. The dispenser provides a conductor contact for the squib firing contact, and provides a return to chassis ground for the squib ground contact. This will be appreciated by one skilled in the art of payload dispenser systems.

The current implementations of such voltage-based systems, however, have a number of drawbacks. First, because they use direct current voltage levels, an electromagnetic pulse ("EMP") or shorts can cause spurious firing of payloads which is a real concern. Second, prior art multiple-payload single-conductor systems generally require specialized payload cartridges that include the circuitry necessary to discriminate between the various voltage levels. Thus, standard payloads cannot be used in these systems when they rely on different voltage levels to fire the different payloads. Third, these systems typically require a great deal of wiring between the voltage source, sequencer switch, and the payload dispenser itself. Any improvements that would reduce these problems would be greatly desirable.

SUMMARY OF THE INVENTION

According to one aspect of a payload dispenser system constructed according to the invention, squibs are selectively fired by providing appropriate frequency signals to a bandpass filter network. The filter of the chosen pass frequency passes the signal from a variable frequency source to its associated squib, causing that squib alone to fire.

In another aspect according to the invention, both voltage and frequency discriminatory networks are provided as a unit within a payload dispenser system. They are either provided at a location near the payload dispenser itself, reducing wiring in a vehicle using such a system, or physically incorporated into the payload dispenser. This allows standard squibs to be used, while reducing overall wiring.

BRIEF DESCRIPTION OF THE DRAWINGS

A better understanding of the present invention can be obtained when the following detailed description of the preferred embodiment is considered in conjunction with the following drawings, in which.

Figures 8, 9:
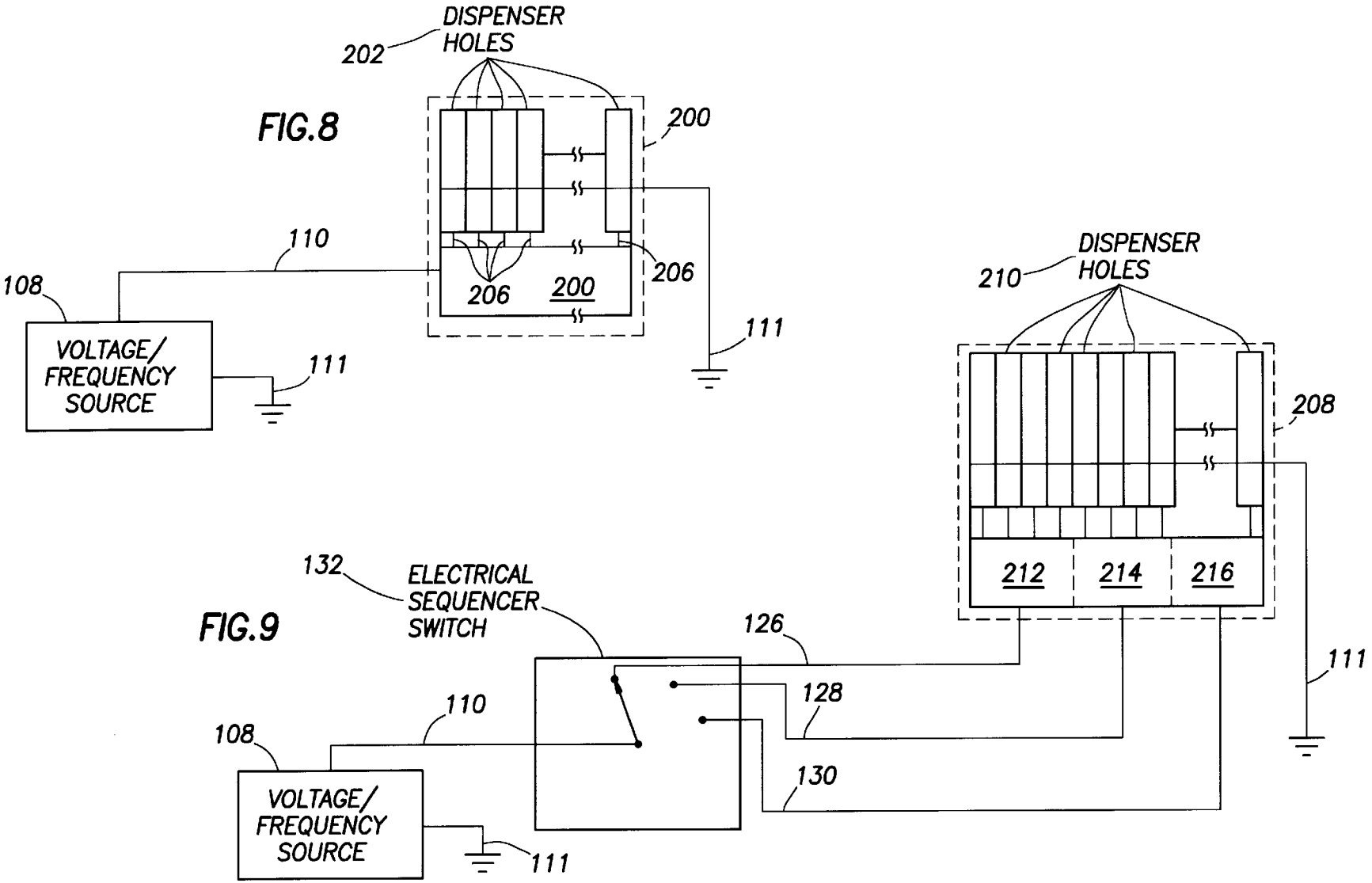
Figure 10:
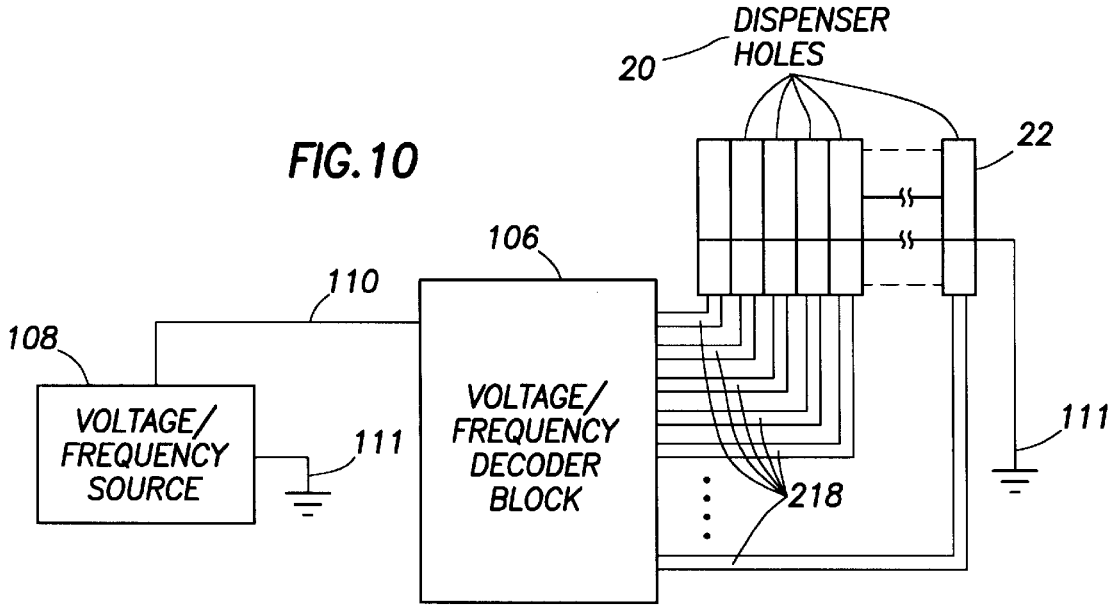
Figure 11A:
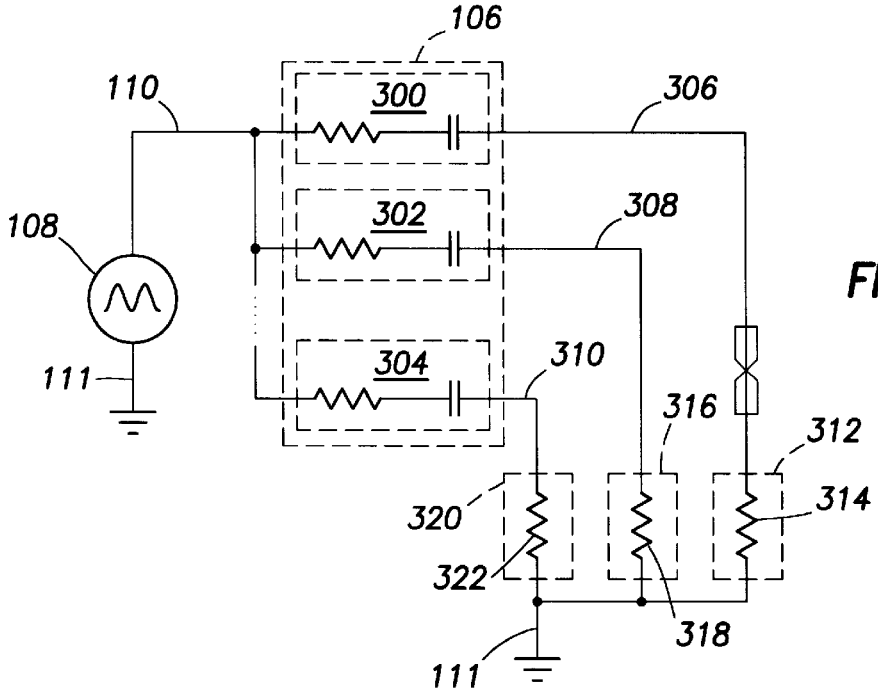
Figure 11B:
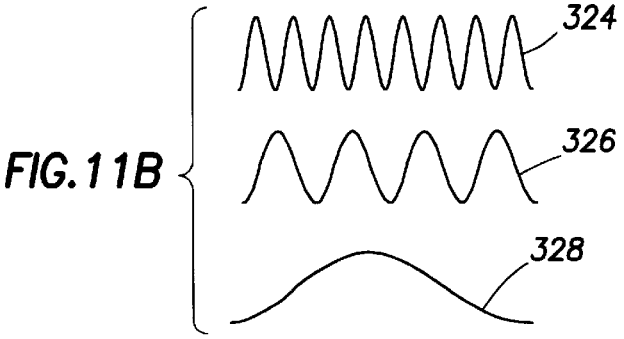
Figure 14:
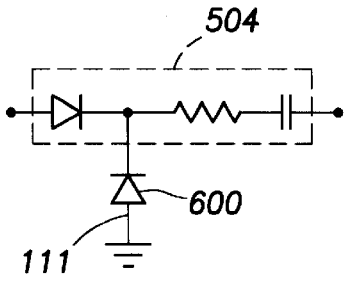
Figure 12:
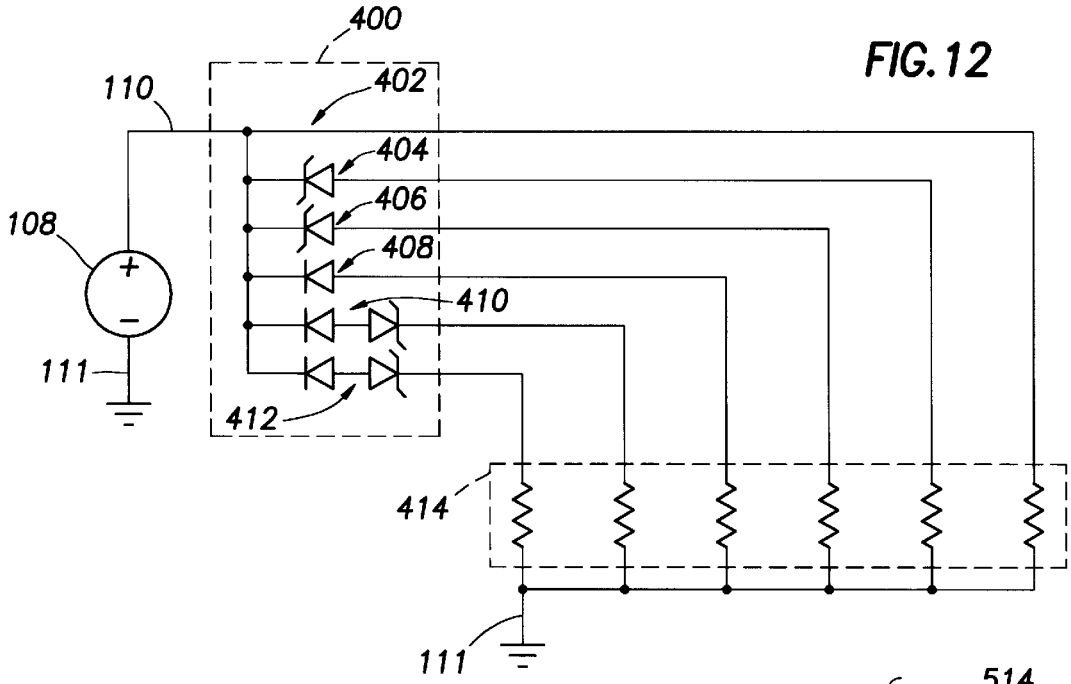
Figure 13A:
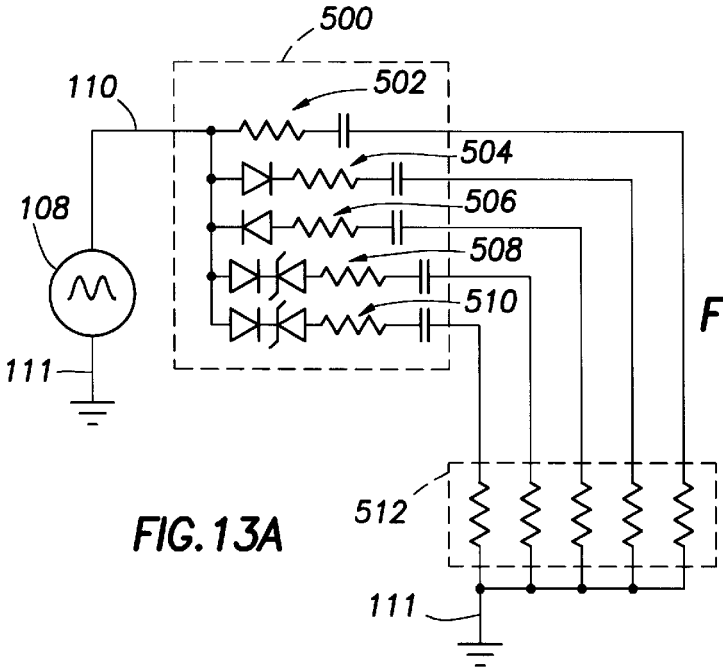
Figure 13B:
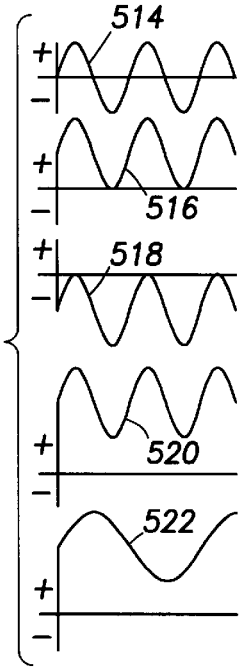
Figure 15:
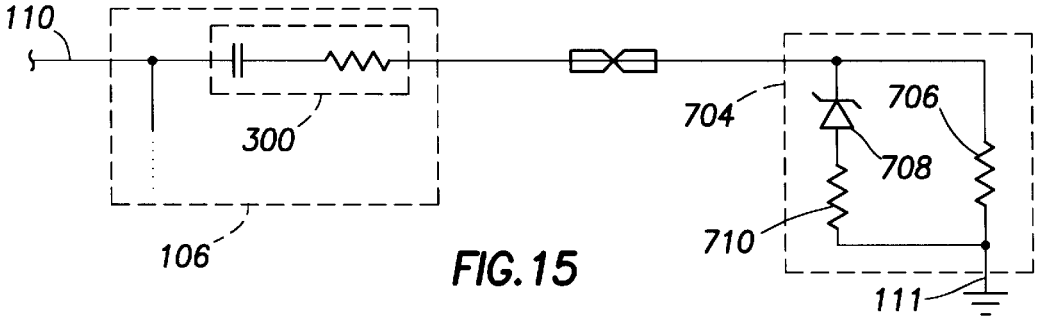
Figure 16:
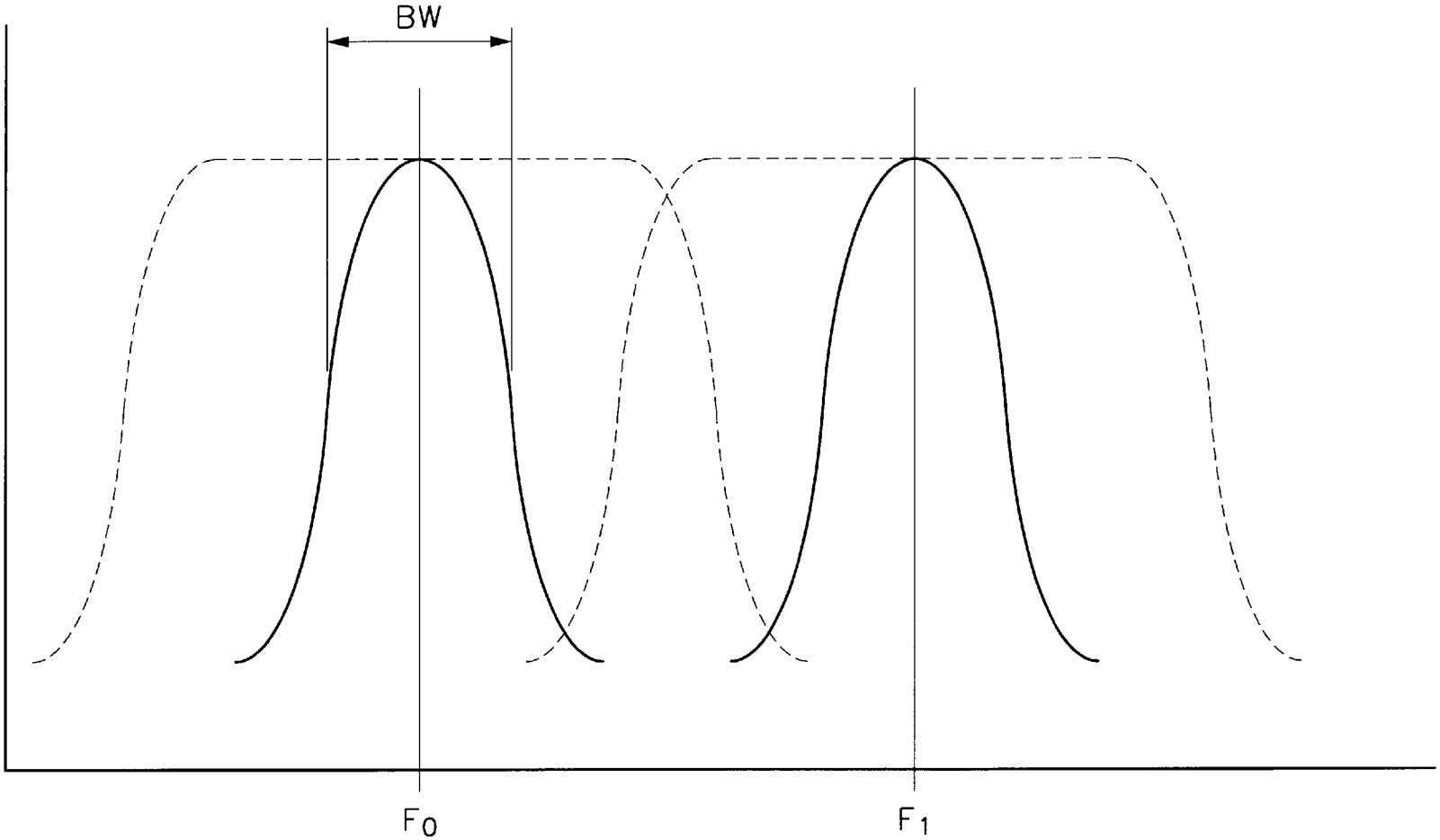

FIG. 8 is a block diagram of a payload dispenser system according to the invention in which a voltage/frequency decoder is incorporated into the payload dispenser itself;

FIG. 9 is a block diagram of a payload dispenser system according to the invention in which multiple voltage/frequency decoders are incorporated within a payload dispenser for use in conjunction with an electrical sequencer switch;

FIG. 10 is a block diagram of a payload dispenser system according to the invention in which a voltage/frequency decoder is used in conjunction with a dual conductor per dispenser hole payload dispenser;

FIGS. 11A and 11B are a schematic illustrations and accompanying waveform diagrams of a bandpass filtering discriminator network used to fire squibs according to the invention;

FIG. 12 is a schematic illustration of a voltage level discriminator block constructed according to the invention;

FIGS. 13A and 13B are a schematic illustration and accompanying waveform diagrams of a discriminator block according to the invention incorporating both bandpass filtering and voltage level discrimination;

FIG. 14 is a schematic illustration of the use of a flyback diode in conjunction with the filtering according to the invention;

FIG. 15 is a schematic illustration of circuitry according to the invention for using bandpass filtering in conjunction with a dual voltage level squib; and FIG. 16 is a frequency diagram illustrating the bandpass frequencies of a typical voltage/frequency decoder implemented according to the invention.

DETAILED DESCRIPTION OF THE PREFERRED EMBODIMENT

Figure 1:
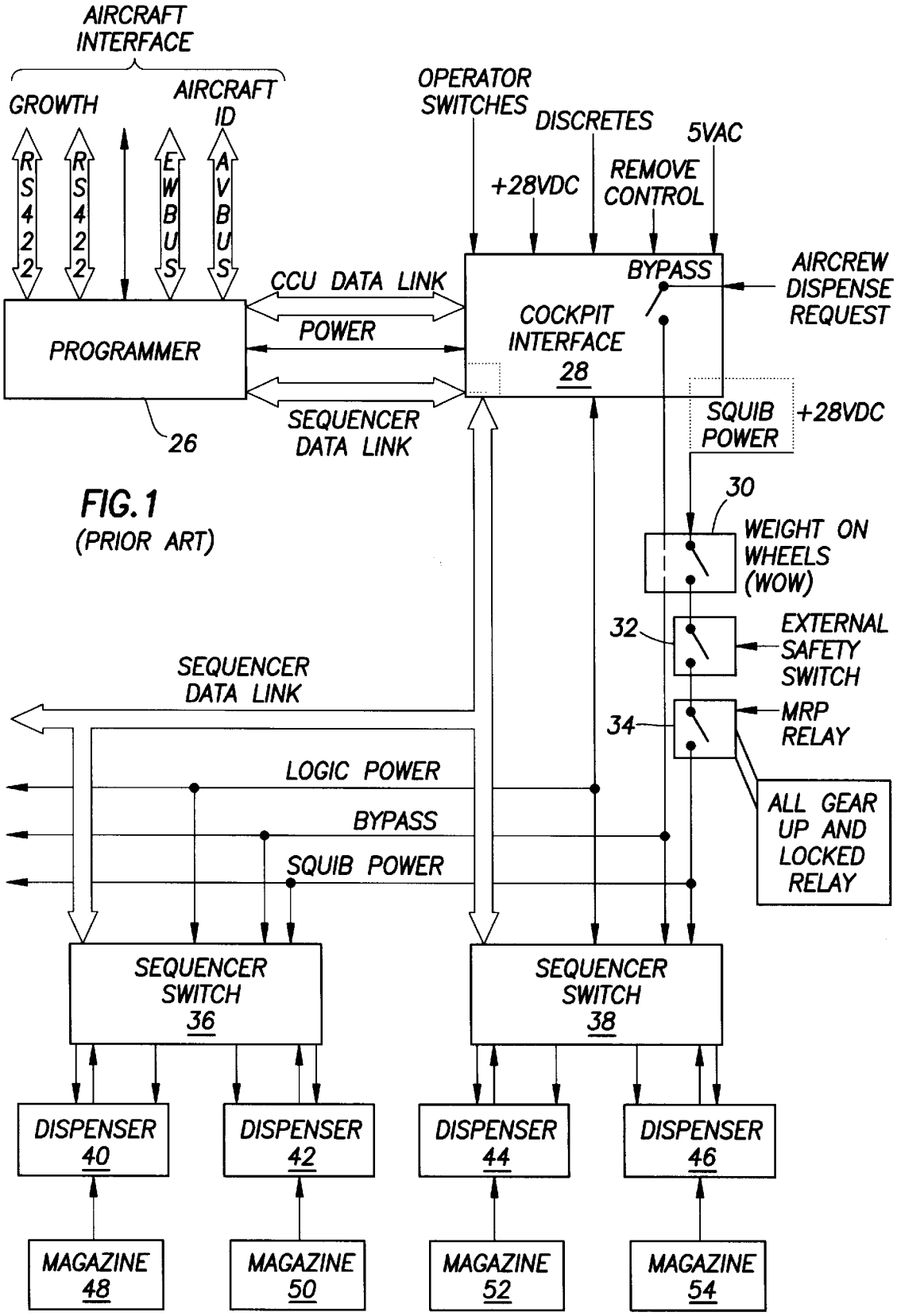
FIG. 1 (PRIOR ART)
FIG. 1 is a block diagram showing a system overview of a typical payload dispenser system and how it is connected to other components within a vehicle.

Turning now to the drawings, FIG. 1 shows a typical prior art system used to dispense payloads in an aircraft, for example. This figure provides an overview for better understanding of the details and advantages of applicant's disclosed embodiment described below.

A command and control unit (programmer) 26 is connected to various aircraft digital and analog data buses. It processes the data from these buses and then communicates with a cockpit interface 28 over a command and control unit data link and a sequencer data link. The cockpit interface includes various inputs, such as operator switches, 28 volt DC, discrete inputs, remote control, and 5 volt AC. It further includes an air crew dispense request bypass switch which allows the air crew to individually dispense payloads should the programmer 26 fail. Squib power of 28 volt DC is provided through a weight-on-wheels switch 30, an external safety switch 32 (typically disabled while the aircraft is on the ground and being loaded), and an all-gear-up and locked relay 34. When there is no weight on the wheels (i.e., the aircraft is flying), the external safety switch has been closed, and all gear is up and locked, squib power is then provided to sequencer switches 36 and 38. The sequencer switches 36 and 38 also receive data from the cockpit interface 28 through a sequencer data link as well as receive logic power, bypass from the air crew dispense request bypass switch, and squib power from the all-gear-up and locked relay 34. Via the sequencer data link, the sequencer switches 36 and 38 receive commands to fire various payloads. Alternatively, if the air crew dispense request bypass switch is engaged, the air crew can manually dispense payloads if the programmer 26 should fail.

In typical systems, each sequencer switch 36 and 38 individually can control two dispenser units, here designated as the dispensers 40, 42, 44, and 46. The dispensers 40 and 42 communicate with the sequencer switch 36, while the dispensers 44 and 46 communicate with the sequencer switch 38.

The dispensers 40–46 are all typically integral to the aircraft or vehicle itself. They include contacts for forming an electrical connection, both signal and ground, to squibs within payloads. These payloads are typically loaded along with their squibs into magazines 48, 50, 52, and 54, and the magazines are mounted on or into the dispensers 40–46.

Figure 2:
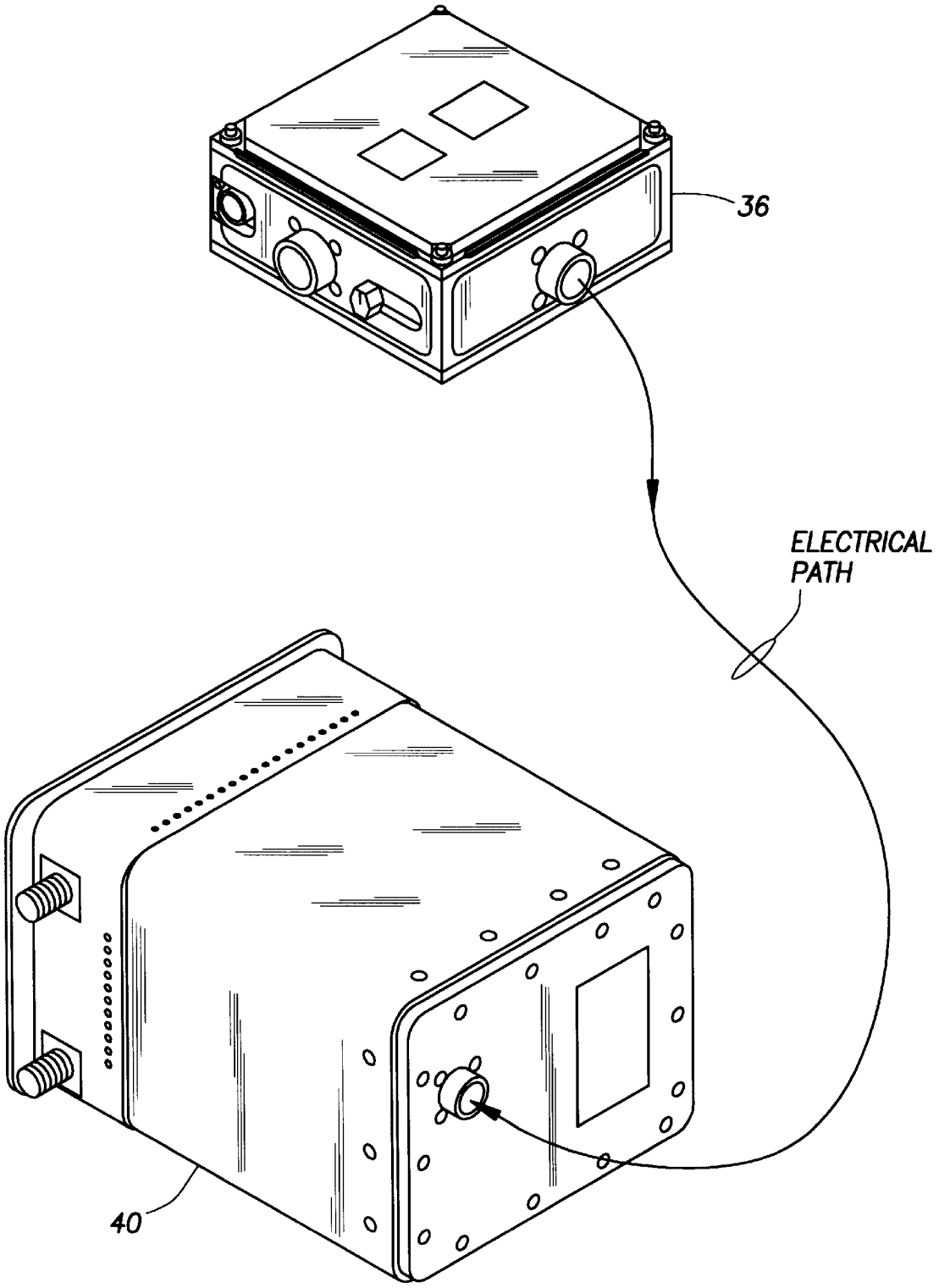
FIG.2 (PRIOR ART)
FIG. 2 is a line drawing illustration of a sequencer switcher and payload dispenser.

Turning to FIG. 2, shown is a typical sequencer switch 36 along with its dispenser 40. The magazine 48 would be mounted within the dispenser 40, and an electrical path links the sequencer switch 36 to the dispenser 40. This path can typically be up to 15 feet, and in prior art systems, included a separate signal conductor for each squib to be fired.

Figure 3:
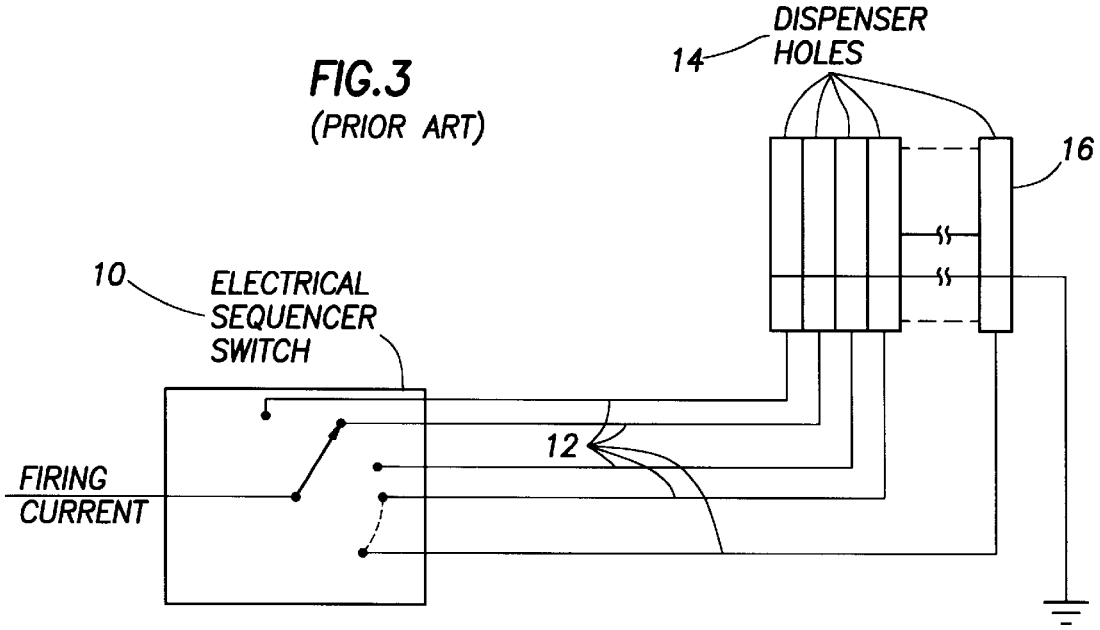
FIG.3 (PRIOR ART)
FIG. 3 is a block diagram of a prior art payload dispenser system in which a single conductor is provided to each dispenser hole.

Turning to FIG. 3, a block diagram is shown illustrating how an electrical sequencer switch 10 is used to fire payloads within a dispenser system. In such prior art systems, the electrical sequencer switch 10 was typically used to route a fixed firing current over separate conductors 12 to a number of dispenser holes 14 located within a payload dispenser 16. Here, the term "dispenser hole" is used to indicate each dispenser contact that forms a connection with a payload in a magazine hole. The magazine is typically mounted to the payload dispenser 16 itself. In the prior art system of FIG. 3, single payloads with a single squib would typically be used, with one payload-squib combination being inserted into each of the magazine holes corresponding to the dispenser holes 14. To fire, the electrical sequencer switch 10 would be logically rotated by the programmer 26 to the next position and a firing current would then be provided through the electrical sequencer switch 10.

Figure 4:
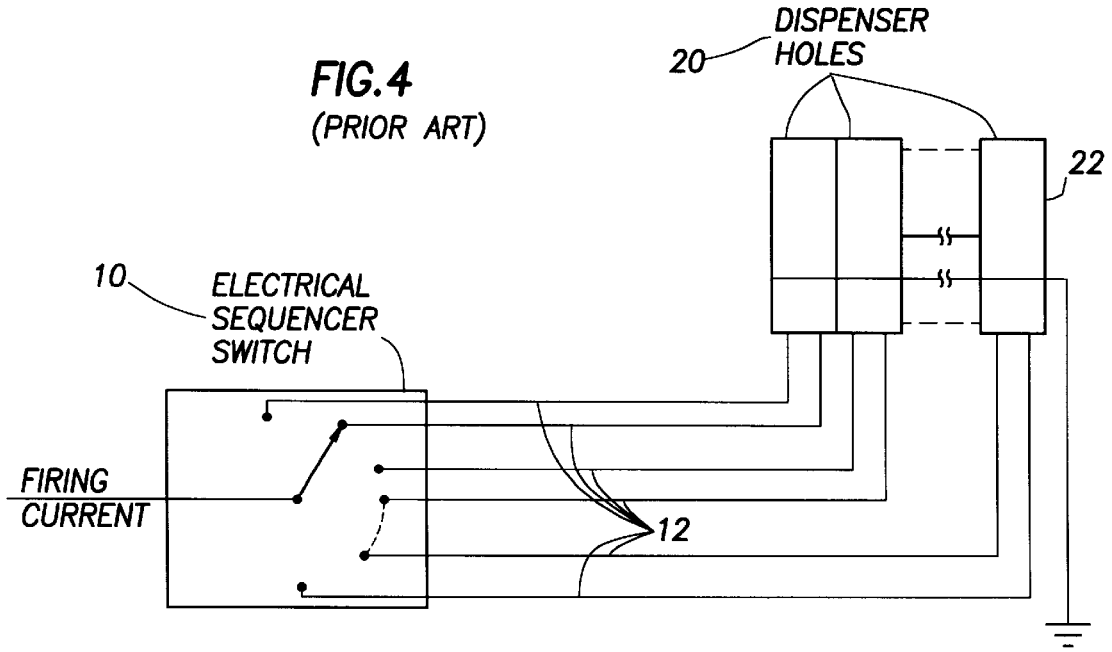
FIG.4 (PRIOR ART)
FIG. 4 is a block diagram of a prior art payload dispenser system in which two conductors are provided to each dispenser holes to fire multiple payloads from each dispenser hole.

FIG. 4 illustrates an alternative prior art system using multiple squib-payload combinations per magazine hole. In the system of FIG. 4, the same electrical sequencer switch 10 is used, again routing a fixed firing current but in this case the various conductors 12 are provided in pairs to dispenser holes 20 within a payload dispenser 22. In this case, payloads would typically be stacked or placed side-by-side within individual magazine holes corresponding to dispenser holes 20, with two conductors 12 being provided per payload-squib combination. Smaller payloads allowed for such a configuration in which standard dispensers could be rewired to fire twice as many payloads. Both of these prior art systems are described and fully disclosed in U.S. Pat. Nos. 4,135,455, and 4,313,379 which have been previously incorporated by reference.

As can be seen from FIGS. 3 and 4, such prior art systems required separate conductors 12 to be provided from the electrical sequencer switch 10 to each payload that is to be fired. Extensive wiring can be especially troublesome in military applications, where each conductor presents a potential for failure. So subsequent systems were developed that reduced the amount of wiring necessary to deploy payloads from dispenser systems. For example, referring back to FIG. 3, a similar system was disclosed in U.S. Pat. No. 4,313,379, but instead of the firing current being a constant current, that firing current was voltage encoded. A single-contact multiple-payload unit was inserted into each of the magazine holes corresponding to the dispenser holes 14. This multiple payload unit included two squib firing elements in electrical parallel, but with one of the squibs being in series with voltage-dependent Zener diode. When the firing current was of a first voltage high enough to fire a squib, but lower than the breakdown voltage of the Zener diode in series with a second squib, the first squib would fire. Then, when the firing current was raised to a voltage higher than the Zener breakdown voltage by an amount sufficient to fire a squib, the second squib would fire. Using these voltage encoded payload units, multiple payloads could be deployed using a single conductor. Such a system is disclosed in U.S. Pat. No. 4,313,379, which has previously been incorporated by reference.

A problem with such a system is that it requires special payloads. That is, each multiple payload package must include the circuitry necessary to provide for blocking the first voltage to prevent the firing of the second squib. This increases the expense and complexity of the payloads, and further makes them unique to the particular system installed.

Figure 5A:
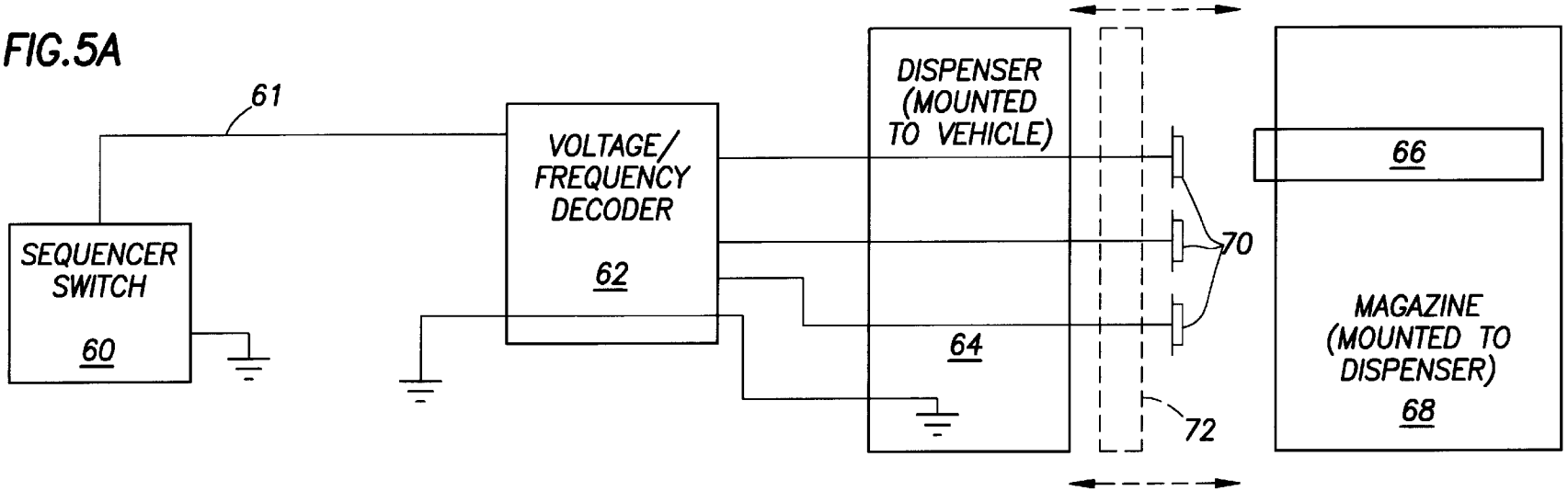
FIGS. 5A and 5B are block diagrams of dispenser systems implemented according to the invention showing how the voltage/frequency decoder is used in conjunction with the payload dispenser.

The foregoing deficiencies are addressed by the voltage/frequency encoded multiple payload dispenser of FIG. 5A. FIG. 5A is a block diagram of a system implemented according to the invention which allows for a single signal conductor to fire all of the payloads in a magazine connected to a dispenser. A standard sequencer switch 60 is used and connected to ground, but rather than providing multiple conductors, it provides a single signal conductor 61 to a voltage/frequency decoder 62. The voltage/frequency decoder 62 then decodes the signal over the single signal conductor 61 based on the voltage, frequency, or both, of that signal, and provides the appropriate conductors to fire each of a number of squibs 70 which has been contacted by a dispenser 64. Each of the squibs 70 includes a corresponding standard payload 66 in a magazine 68, as in prior art systems.

Using this system, a great deal of wiring between the sequencer switch 60 and the dispenser 64 is eliminated. The length of the wiring could typically reach up to 15 feet. Now, instead of multiple conductors, a single conductor 61 is used.

Alternatively, rather than providing a separate voltage/frequency decoder 62, that unit can be integrated into the dispenser 64 itself, as is illustrated by the outline of an integral voltage/frequency decoder 72. In this case, the single conductor 61 would be provided to the dispenser 64, and the integral voltage/frequency decoder 72 would then provide the appropriate signals to the squib 70. The inner workings of the voltage/frequency decoder 62 is further described below.

Figure 5B:
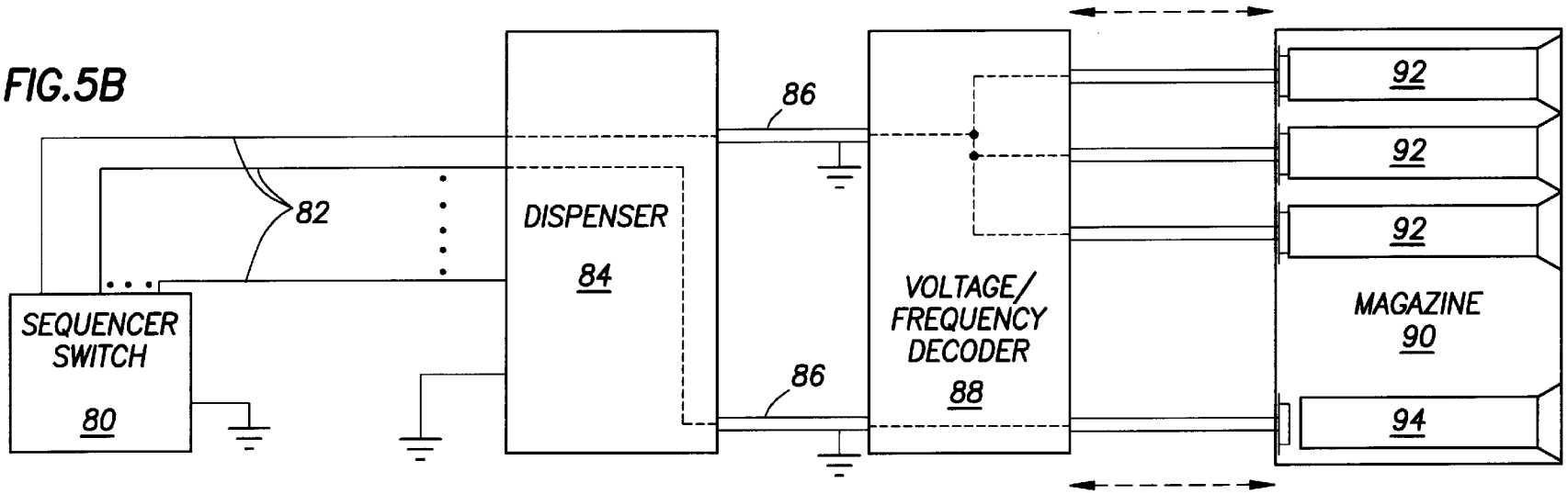

Turning to FIG. 5B, shown is a block diagram of a system implemented according to the invention in which a voltage/frequency decoder is physically mounted to a magazine, rather than incorporated into a dispenser. Sequencer switch 80 is again provided, but in this case, all of its signal lines 82 are used, typically thirty. In this case, the signal lines 82 are provided to a dispenser 84, which is again typical of prior art dispensers. The dispenser 84 would typically have thirty conductor pairs 86 for signal and ground, each of the conductor pairs 86 corresponding to one of the signal lines 82.

According to the invention, rather than the conductor pairs 86 directly contacting a magazine 90, a voltage/frequency decoder 88 is directly mounted to the magazine 90 as an adaptor for contacting the conductor pairs 86. The magazine 90 could include, for example, up to ninety payload/squib combinations 92 and 94, rather than thirty as would be used with a standard magazine.

These payload/squib combinations 92 and 94 are then brought into contact with contacts on the voltage/frequency decoder 88, one pair of contacts (signal and ground) for each squib in the payload/squib combinations 92 and 94. The voltage/frequency decoder 88 includes the voltage or frequency discrimination circuitry discussed below, allowing each of the conductor pairs 86 to selectively fire one of three of the payload/squib combinations 92 and 94. As shown, three of the payload/squib combinations 92 are coupled to one of the conductor pairs 86, while the payload/squib combination 94 (and two other counterparts not shown) are coupled to another conductor pair 86. This would be repeated for all thirty of the conductor pairs 86, and as will be appreciated, even a greater number of payload/squib combinations could be fired by a single conductor pair 86.

In this way, the voltage/frequency decoder 88 is directly mounted to the magazine 90 before the magazine is placed within the dispenser 84. The thirty contacts in the dispenser 84 corresponding to dispenser holes then come into contact with corresponding contacts on the voltage/frequency decoder 88. Thus, this forms an economical adaptor to adapt to prior art dispenser systems.

It will be appreciated that either the sequencer switch 80, or signal supplies to the sequencer switch 80, must then be adapted to provide a voltage or frequency signal appropriate to fire one of the payload/squib combinations 92 or 94. But existing wiring within an aircraft need not be changed in order to fire even more squibs. Again, the voltage/frequency decoder 88 is further described below.

Figure 6:
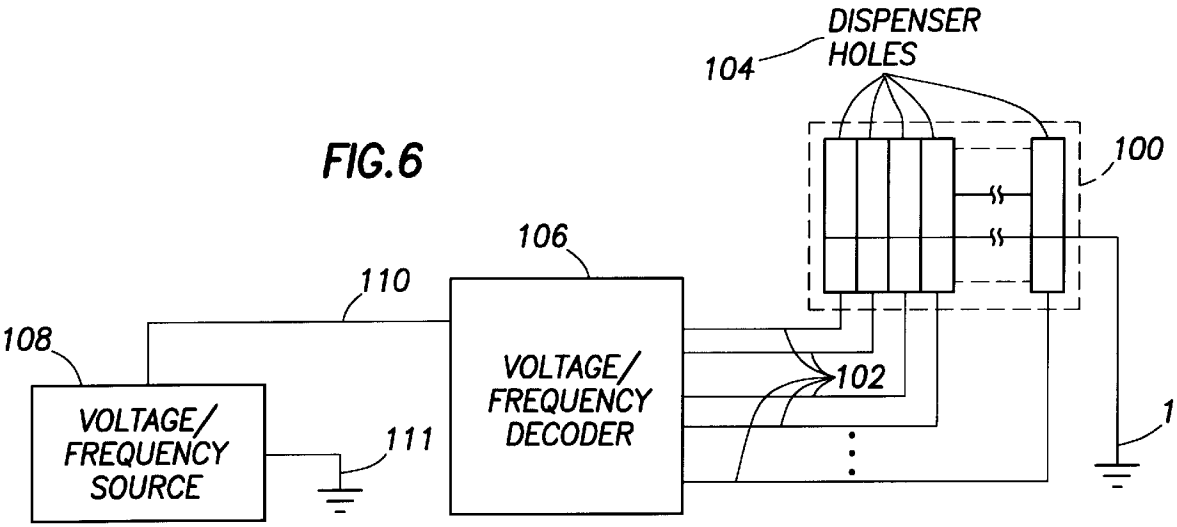
FIG. 6 is a block diagram of a payload dispenser system according to the invention incorporating a voltage/frequency decoder.

Turning to FIG. 6, one implementation of a voltage/frequency decoder in conjunction with a voltage/frequency source is illustrated. The multiple payload dispenser system of FIG. 6 includes a standard payload dispenser 100, similar to the payload dispenser 16 of FIG. 3, with separate conductors 102 individually connected to each of a series of dispenser holes 104, which correspond to magazine holes. Instead of payloads being individually fired by an electrical sequencer switch 10, as is illustrated in FIG. 3, each of the payloads placed in the magazine holes corresponding to the dispenser holes 104 is fired by its corresponding conductor 106 from a voltage-frequency decoder 106. The voltage/frequency decoder 106 receives a single signal over a conductor 110 from a voltage/frequency source 108, and provides signals on the separate conductors 102 to fire the payloads corresponding to the dispenser holes 104. The inner workings of the voltage/frequency decoder 106 are further described below in conjunction with the discussion of FIGS. 8A–12. But to summarize, the voltage/frequency decoder 106 receives a voltage, frequency, or voltage and frequency encoded signal from the voltage/frequency source 108 and provides filtering to selectively pass the signal over the desired conductor 102. The voltage/frequency decoder 106 is preferably placed fairly close to the payload dispenser 100, and the voltage/frequency source 108 and the payload dispenser 100 are both tied to a common ground 111 to complete the circuit.

This system allows a single conductor 110 to be provided from the voltage/frequency source 108 and routed through the vehicle to a location near the payload dispenser 100. Only then is the signal on the conductor 110 filtered to the separate conductors 102 by the voltage/frequency decoder 106. This reduces routed wiring, improving the reliability of the system. This system also reduces overall weight, a particularly important consideration for aircraft.

Further, the system of FIG. 6 allows for this reduced wiring without modification to existing payload dispensers. The payload dispenser 100 can be simply the payload dispenser 16 of FIG. 3.

Figure 7:
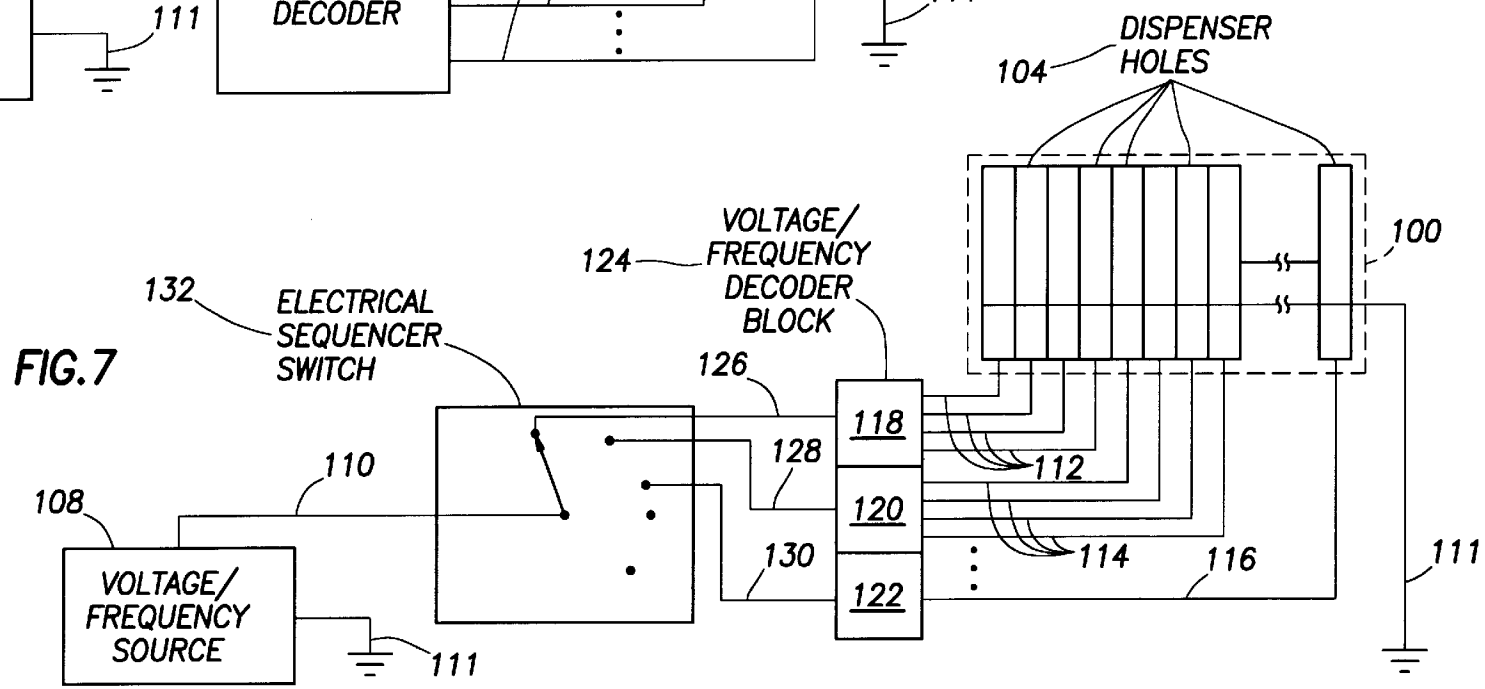
FIG. 7 is a block diagram of a payload dispenser system according to the invention employing multiple voltage/ frequency decoders in conjunction with an electrical sequencer switch.

FIG. 7 illustrates an alternative embodiment according to the invention. The system according to FIG. 7 again employs the payload dispenser 100 with dispenser holes 104, as well as a voltage/frequency source 108.

In FIG. 7, however, the individual dispenser holes 104 within the payload dispenser 100 are connected to a voltage/frequency decoder block 124 which includes three individual voltage/frequency decoders 118, 120 and 122. Each of the individual voltage/frequency decoders is electrically connected to a group of the dispenser holes 104 by a separate group of conductors 112, 114, and 116. The individual voltage/frequency decoders 118, 120, and 122 are each provided as inputs one of three conductors 126, 128, and 130 which are tied to electrical sequencer switch 132. The electrical sequencer switch 132 has as its input the single conductor 110, again from the voltage/frequency source 108.

The system of FIG. 7 permits the voltage/frequency source 108 to sequentially fire each payload in the group of payload dispenser holes 104 that is connected to one of the groups of control lines 112, 114, or 116. The electrical sequencer switch 132 further permits the individual voltage/frequency decoders 118, 120 or 122 to be selectively coupled to the voltage/frequency source 108. This allows existing electrical sequencer switches to be used in a system with the voltage/frequency source 108 to fire a large number of payloads.

Further, although not shown, the electrical sequencer switch could include connections to further blocks of voltage/frequency decoders that are in turn connected to other dispensers, again providing for more selectivity in which payload to fire. Again, the package 124 is preferably located near the payload dispenser 100, reducing the routing of the conductors 112, 114, and 116.

FIG. 8 illustrates an adaptation of the system of FIG. 6 in which the voltage/frequency decoder 106 of FIG. 6 is integrated into the payload dispenser 100. Specifically, the voltage/frequency source 108 now provides the conductor 110 to be routed to a modified payload dispenser 200. This modified payload dispenser 200, as in prior art dispensers, includes multiple dispenser holes 202, but also has an integrated voltage/frequency decoder 204. The voltage/frequency decoder 204 includes individual conductors 206 to each of the dispenser holes 202, and functions similarly to the voltage/frequency decoder 106 of FIG. 6.

As will be appreciated, this system entirely eliminates routed individual conductors for the dispenser holes 202, instead providing for the single conductor 110 to be routed to the modified payload dispenser 200. This, again, reduces failure modes intrinsic to the routing of conductors.

Similarly, FIG. 9 illustrates an adaptation of the system of FIG. 7, in which the voltage/frequency source 108 provides a single conductor 110 to the electrical sequencer switch 132, which provides individual conductors 126, 128, and 130. These individual conductors 126, 128, and 130, however, are then connected to a second modified payload dispenser 208, which includes multiple dispenser holes 210. The payload dispenser 208 further incorporates individual voltage/frequency decoders 212, 214, and 216, similar to the individual voltage/frequency decoders 118, 120, and 122, within the second modified payload modified dispenser 208 itself. This again reduces the amount of routed wiring.

Of note, each of the systems in FIGS. 6–9 reduces the amount of routed wiring, but at the same time permits the use of off-the-shelf single-payload squib technology.

FIG. 10 illustrates how the voltage/frequency decoder 106 of FIG. 8 can be implemented with the dual-conductor dual-squib dispenser 22 of FIG. 4. Instead of a single conductor being provided to each of the dispenser holes 20, conductor pairs 218 are instead provided. Each conductor of these conductor pairs 218 is coupled to a separate filter within the voltage/frequency decoder 106, as is discussed below in conjunction with FIGS. 11A–13.

Turning to FIGS. 11A and 11B, the details of the various voltage/frequency decoders 62, 72, 88, 106, 118, 120, 122, 204, 212, 214, and 216 are shown. Using the voltage/frequency decoder 106 of FIG. 6 as an example, the voltage/frequency source 108 provides a selectable signal over the single conductor 110 to the voltage/frequency decoder 106. Internal to the voltage/frequency decoder 106 are a series of bandpass filters, illustrated by a first bandpass filter 300, a second bandpass filter 302, and a third bandpass filter 304. Each of these bandpass filters is tuned to a separate pass frequency. The bandpass filters 300, 302, and 304 preferably include an inductor and a capacitor as shown, although crystals, resonators, and a wide variety of other circuitry can also be used, including different capacitor/inductor combinations. Further, higher order bandpass filters can be used. This will all be appreciated by one of ordinary skill in the electrical arts.

Each of these bandpass filters 300–304 provides an output to an individual conductor 306, 308, and 310. The first bandpass filter 300 is coupled through its conductor 306 to a first squib 312, which is part of a payload within one of the payload dispenser holes 104. The first squib 312 includes a firing element 314. The second bandpass filter 302 and the third bandpass filter 304 are similarly coupled to a second squib 316 with its firing element 318 and a third squib 320 with its firing element 322 over their conductors 308 and 310.

The bandpass filters 300–304 are each tuned to a particular pass frequency. For example, the first bandpass filter 300 can have a high pass frequency illustrated by the waveform 324 of FIG. 11B. Similarly, the second bandpass filter 302 can have a lower pass frequency as illustrated by the waveform 326, and the third bandpass filter 304 would have an even lower pass frequency as illustrated by the waveform 328.

Using the selectable voltage/frequency source 108, the desired frequency is provided to the voltage/frequency decoder 106 for the desired pass band. Then, only the bandpass filter 300, 302, or 304 with that pass frequency will pass sufficient power to fire its corresponding firing element 314, 318, or 322. It will be appreciated that the selection of the components of the bandpass filter will be known to one of ordinary skill in the electrical arts.

Using the frequency selectivity of the voltage/frequency source 108, differing firing frequencies are thus used to fire each squib 312, 316, and 320. This has a great advantage in that it uses an alternating current. Direct current shorts or electromagnetic pulses are often found in battlefield conditions, which could cause premature firing of a squib. Using this selective alternating current signal, a direct current short would not cause one of the squibs 312, 316 or 320 to fire prematurely.

Turning to FIG. 12, an alternate embodiment of the voltage/frequency decoder 106 is shown. This voltage/frequency decoder 400 relies exclusively on voltages, only passing voltages from the voltage/frequency source 110 that are sufficient to pass through filters 402, 404, 406, 408, 410, and 412 to fire the various firing elements here illustrated as a block 414. Assume, for example, that 10 volts are necessary to fire one of the squibs in block 414. When 10 volts are applied from the voltage/frequency source 108, the squib connected to the filter 402 fires, as that filter 402 includes no filtering components. If the Zener diode in the filter 404 is a 10 volt Zener diode, then 20 volts from the voltage/frequency source 110 are necessary to fire its associated squib. If the Zener diode of the filter 406 is a 20 volt Zener diode, 30 volts are necessary from the voltage/frequency source 110 to fire the associated squib.

The filter 408 only allows negative voltage from the voltage/frequency source 110 to fire the associated squib. In this case, a negative voltage of −10 volts will fire the squib associated with filter 408, and similarly to filters 404 and 406, −20 volts and −30 volts are necessary to fire the squibs associated with the filters 410 and 412.

Although this alternative embodiment of FIG. 12 does not include the direct current blocking of the circuitry disclosed in FIG. 11A, it does provide a unitary interface that can be readily adapted to existing payload dispensers and electrical sequencer switches. Standard squibs can be used and extensive wiring is not needed as in prior art systems.

It will be appreciated that the voltage and frequency aspects of the voltage/frequency decoder 106 of FIG. 11A and the voltage/frequency decoder 400 of FIG. 12 can be combined. This is illustrated in FIG. 13A by a voltage/frequency decoder 500, which includes five filters 502, 504, 506, 508, and 510. Assuming the filters 502–508 are set for the same pass frequency, an appropriate voltage offset is nevertheless necessary to fire the firing element of the group of squibs 512 that is associated with the filters 504, 506, and 508. The filter 502 passes a frequency (whatever the voltage offset) indicated by the waveform 514 of FIG. 13B. The filter 504 passes that same waveform, but only when offset by +5 volts to fire a 10 volt squib as illustrated by the waveform 516. Similarly, the filter 506 requires a negative offset of −5 volts as illustrated by the waveform 518. The filter 508 includes a Zener diode and requires a positive voltage of an offset of 5 volts plus the Zener breakdown voltage, as illustrated by the waveform 520. Finally, assuming the filter 510 includes a different pass frequency but the same Zener diode as the filter 508, it will require a different pass frequency with the same offset to fire its associated squib, as illustrated by the waveform 522.

Turning to FIG. 14, it will be appreciated that because there is an inductor in the various filters of FIGS. 11A and 13A, a freewheeling diode 600 will be necessary to provide a return current path for the bandpass filters and the squib. Although the free wheeling diode 600 is not illustrated in FIGS. 11A and 13A for clarity, one of ordinary skill in the art will appreciate how it must be installed.

Turning to FIG. 15, it will be appreciated that the frequency specific firing can also be used with previously developed dual voltage-encoded squibs, as described in U.S. Pat. No. 4,313,379. In FIG. 15, the voltage/frequency decoder 106 is illustrated with its first filter 300, but here coupled to a dual, voltage encoded squib 704. If a signal of appropriate frequency but with a zero average voltage is provided to the first filter 300, this will cause the first firing element 706 of the squib 704 to fire. If the alternating current signal is offset by a voltage appropriate to overcome the breakdown voltage of the Zener diode 708 within the voltage encoded squib 704, then a second firing element 710 will fire, expending the second payload. In this way, the voltage/frequency decoder 106, and its counterparts, can be used with voltage encoded squibs.

Turning to FIG. 16, a frequency diagram is shown illustrating how one would choose the center frequencies for the various filters. Factors to be considered are the resonant frequency, bandwidth, frequency spacing, and voltage/current amplitudes which include the input power source, the input voltage, the number of squibs, the acceptable series impedance, and the EMI (electromagnetic interference) constraints on the system. Further, low frequency resonant circuits typically require larger volume than high frequency resonance circuits. A typical dispenser system operating from a 28 volt DC source would have the following characteristics. Since a Q (quality factor of the resonant circuit) of 10 is easily achievable using inductors and capacitors, this will determine the frequency spacing. Center frequencies of 50 kHz, 95 kHz, 170 kHz, etc., are selected based on this Q factor. The spacing is not linear because the queue has been selected as constant. If the Q factor of each successive bandpass network is increased as frequency goes up, then the frequency can be evenly spaced. This series impedance at resonance is typically one ohm or less to minimize available voltage loss across the bandpass network—typically a 4 volt drop at 4 amps. Four amps is typically required to ignite a squib. Referring to FIG. 15, the bandwidth BW of a first center frequency $F_0$ is shown as not overlapping with the band width of the next center frequency $F_1$. If the quality factor Q of the circuits were decreased, the dashed line illustrates the increasing overlap, requiring a wider spacing of frequencies.

Referring back to FIG. 1, it will be appreciated that the various voltage/frequency sources can be implemented in various places throughout the entire system. Typically, the voltage/frequency source would replace the "squib power" as illustrated in the prior art of FIG. 1, and that voltage/frequency source would be further controlled by the programmer 26 or the cockpit interface 28. Alternatively, a voltage/frequency source could be implemented within each of the sequencer switches 36 and 38. Wherever the selectable voltage/frequency signal is generated, it eliminates wiring between the sequencer switches 36 and 38 and their dispensers 40, 42, 44, and 46.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

What is claimed is:

1. A multiple payload dispenser system, comprising:

(a) a signal source providing a frequency selectable signal of a frequency;

(b) a filter network with a plurality of frequency dependent filters, the filter network connected to the signal source and receiving the frequency selectable signal, the frequency dependent filters in the filter network selectively passing the frequency selectable signal dependent on the frequency of the frequency selectable signal, and the plurality of frequency dependent filters providing a plurality of corresponding outputs; and (c) a payload dispenser having a plurality of payload dispenser holes for squib-fired payload units, the plurality of dispenser holes coupled to the plurality of outputs of the plurality of frequency dependent filters.

2. The system of claim 1, wherein the plurality of dispenser holes are contained in a single payload dispenser.

3. The system of claim 1, wherein each of the plurality of dispenser holes is connected to one of the plurality of corresponding outputs.

4. The system of claim 1, wherein each of the plurality of dispenser holes is connected to two of the plurality of corresponding outputs.

5. The system of claim 1, wherein the plurality of frequency dependent filters in the filter network further comprises voltage dependent filters, wherein the frequency selectable signal from the signal source further includes a selectable voltage offset, and wherein the plurality of frequency dependent filters selectively passes the frequency selectable signal based on both the frequency and voltage offset of the frequency selectable signal.

6. The system of claim 1, wherein the filter network is coupled to the signal generator via an electrical sequencer switch.

7. An adapter for coupling a voltage/frequency source to a payload dispenser unit with a plurality of dispenser holes, the adapter comprising:

(a) an input for receiving an input signal from the voltage/frequency source;

(b) a plurality of outputs for providing a plurality of signals to the plurality of dispenser holes; and (c) a plurality of filters providing the plurality of outputs, the plurality of filters all coupled to the input and passing selective signals based on the input signal.

8. The adapter of claim 7, wherein the adapter is physically located near the payload dispenser.

9. The adapter of claim 7, wherein the adapter is physically incorporated into the payload dispenser.

10. The adapter of claim 7, wherein the adaptor is physically attached to a magazine that holds payloads, where the magazine is then suitable for coupling with the payload dispenser unit.

11. The adapter of claim 7, wherein the plurality of filters have a plurality of distinct pass frequencies.

12. The adapter of claim 7, wherein the plurality of filters have distinct voltage pass levels.

13. A multiple payload dispenser system, comprising:

(a) a signal source providing a selectable signal of a voltage or frequency;

(b) a filter network with a plurality of filters, the filter network connected to the signal source and receiving the selectable signal, the filters in the filter network selectively passing the signal dependent on the voltage, frequency, or both of the selectable signal, and the plurality of filters providing a plurality of corresponding outputs; and (c) a payload dispenser having a plurality of payload dispenser holes for squib-fired payload units, the plurality of dispenser holes coupled to the plurality of outputs of the plurality of filters.

14. The system of claim 13, wherein the plurality of dispenser holes are contained in a single payload dispenser.

15. The system of claim 13, wherein each of the plurality of dispenser holes is connected to one of the plurality of corresponding outputs.

16. The system of claim 13, wherein each of the plurality of dispenser holes is connected to two of the plurality of corresponding outputs.

17. The system of claim 13, wherein the filter network is coupled to the signal generator via an electrical sequencer switch.

18. A method of firing a squib in a payload dispenser system, the method comprising:

a) providing a frequency selectable signal of a selectable frequency;

b) filtering the frequency selectable signal through a filter with a pass frequency; and c) if the selectable frequency of the frequency selectable signal is equal to the pass frequency, providing the frequency selectable signal to the squib, firing the squib.

* * * * *